US005554971A

United States Patent [19]

Foster et al.

[11] Patent Number: 5,554,971

[45] Date of Patent: Sep. 10, 1996

[54] VIBRATING APPARATUS FOR LOW PROFILE PAGERS

[75] Inventors: Jewett E. Foster, Elgin; Glen O. Reeser, Palatine, both of Ill.

[73] Assignee: Motorola, Inc., Schaumburg, Ill.

[21] Appl. No.: 417,722

[22] Filed: Apr. 6, 1995

Related U.S. Application Data

[63] Continuation of Ser. No. 983,207, Nov. 30, 1992, abandoned.

[51] Int. Cl.[6] ..... G08B 5/22

[52] U.S. Cl. ..... 340/825.46; 340/407.1

[58] Field of Search ..... 340/825.46, 825.44, 340/480, 487, 407.1, 407.2; 368/244, 250; 434/114

[56] References Cited

U.S. PATENT DOCUMENTS

| | | | |
|---|---|---|---|
| 4,028,502 | 6/1977 | Moricca et al. | 340/407.1 |
| 4,119,811 | 10/1978 | Moricca et al. | 340/407.1 |
| 4,225,965 | 9/1980 | Baugh | 340/407.1 |
| 4,380,759 | 4/1983 | Sulkaski et al. | 340/407.1 |
| 5,107,540 | 4/1992 | Mooney et al. | 340/407.1 |
| 5,379,032 | 1/1995 | Foster et al. | 340/825.46 |

FOREIGN PATENT DOCUMENTS

| | | | |
|---|---|---|---|
| 1017955 | 10/1957 | Germany | 340/825.46 |

*Primary Examiner*—Michael Horabik
*Assistant Examiner*—Edward Merz
*Attorney, Agent, or Firm*—Susan L. Lukasik

[57] ABSTRACT

Vibratory alertion of received messages to subscribers of low profile pagers can be achieved in the following manner. On the substrate, or pager housing, attaching a pivotal post and a bumper a predetermined distance from the pivotal post. Attaching a substantially planar polarizable material to the pivotal post such that the polarizable material is substantially parallel to the substrate and when in motion, moves substantially parallel to the substrate. The polarizable material is set in motion by an excitation winding which provides a varying field.

7 Claims, 2 Drawing Sheets

VIBRATING APPARATUS FOR LOW PROFILE PAGERS

This is a continuation of application Ser. No. 07/983,207, filed Nov. 30, 1992 and now abandoned.

FIELD OF THE INVENTION

This invention relates generally to alertion of pager subscribers and, in particular, to alertion of pager subscribers via vibrating apparatuses.

BACKGROUND OF THE INVENTION

Pagers are known to inform a subscriber of a received message. The received messages typically indicate the telephone number of the person who paged the subscriber such that the subscriber can get in touch with the person initiating the message. The subscriber can be alerted of the message by a beep or tone indication, voice message, or vibration indication.

As technology advances, consumers want smaller and better products such as the wrist watch pager manufactured by Motorola which beeps to alert the subscriber that a message has been received. In some applications, however, a beep alert may be inappropriate. For example, a member of the police force working undercover or on surveillance may be placed in jeopardy by receiving a beep indication of a page message. Thus, vibration alerts can be used. Present vibrating indicators are of the motor driven with cam type or of the tubular type which shake the pager housing. While these vibrating indicators work well in many applications, they do not lend themselves well to low profile pagers. Therefore a need exists for a vibrating indicator for low profile pagers.

DESCRIPTION OF A PREFERRED EMBODIMENT

Generally, this invention provides a means for alerting a pager subscriber of a received message via vibrations. Upon receipt of a message, a polarizable material attached to a pivotal post is excited. The excited polarizable material is set in motion and repeatedly collides with a bumper causing the pager to vibrate. Because of its size, this apparatus lends itself well to low profile pagers.

Figure 1:
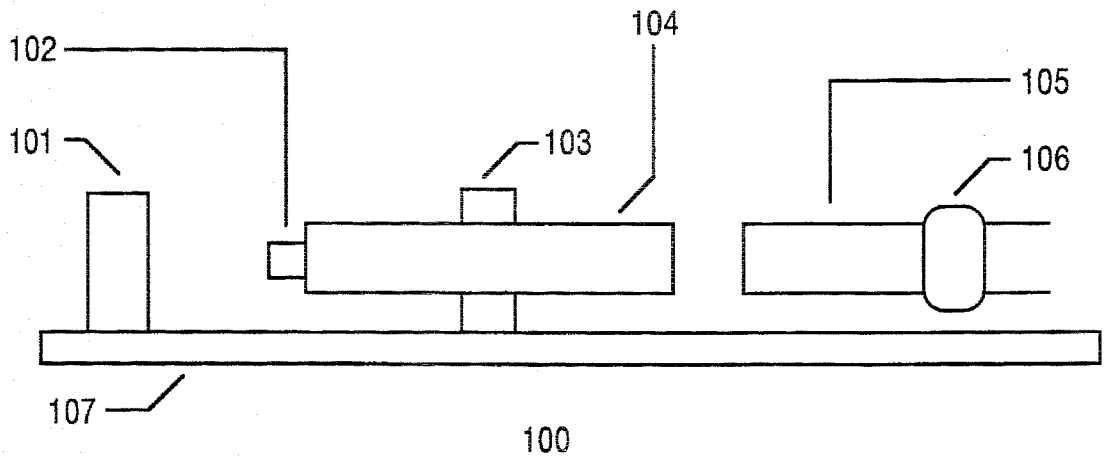
FIG. 1 illustrates a vibrating apparatus in accordance with the present invention.

This invention can be more fully described with reference to FIGS. 1–3. FIG. 1 illustrates a vibrating apparatus 100 that includes a bumper 101, a resilient material 102, a pivotal post 103, a polarizable material 104, an excitation means 105 which includes windings 106, and a substrate 107. The resilient material 102 may comprise rubber. The polarizable material may comprise iron or permanent magnet. The excitation means 105 may comprise at least one magnet with inductive windings. The substrate 107 may comprise the pager housing. These elements are known, thus no further description will be presented. The vibrating apparatus 100 further comprises a resilient material disposed substantially between the polarizable material and the first bumper 101 such that when the polarizable material 104 pivots toward the first bumper 101, the resilient material absorbs a portion of the impact.

Figure 2:
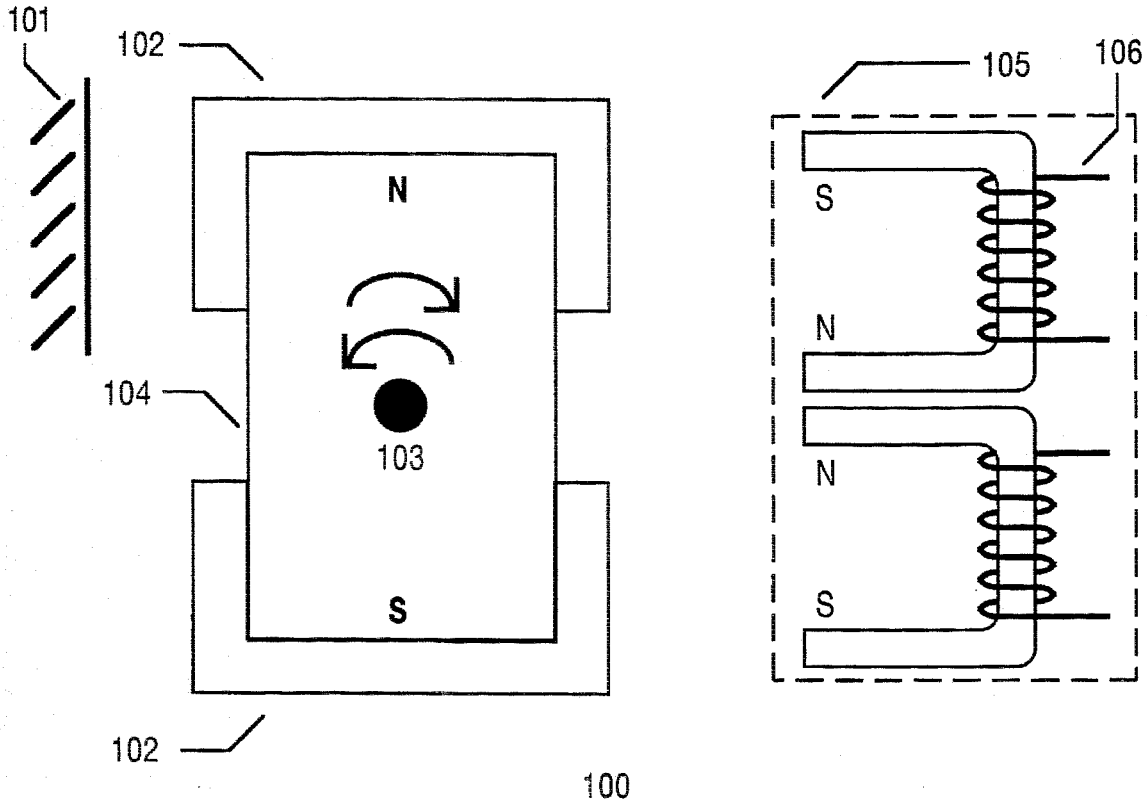
FIG. 2 illustrates a top view of a vibrating apparatus in accordance with the present invention.

FIG. 2 illustrates a top view of a vibrating apparatus 100 that includes the bumper 101, the resilient material 102, the pivotal post 103, the polarizable material 104, the excitation means 105 including windings 106. These elements are known thus no further description will be presented except to facilitate the understanding of the present invention. When a message is received by the pager, a voltage is applied to the excitation means 105 to create an electromagnetic field. This polarized field causes attraction at one end of the polarizable material 104 and repulsion at the other end of the polarizable material. The polarities of the electromagnetic field are then switched causing an attraction at the end of the polarizable material that previously had repulsion and repulsion at the end of the polarizable material that previously had attraction. Switching the polarities of the excitation means 105 back and forth at a rate of 70–110 Hz causes the polarizable material to pivot back and forth about the pivotal post which leads to repeated collisions with the bumper 101 causing the pager to vibrate.

Figure 3:
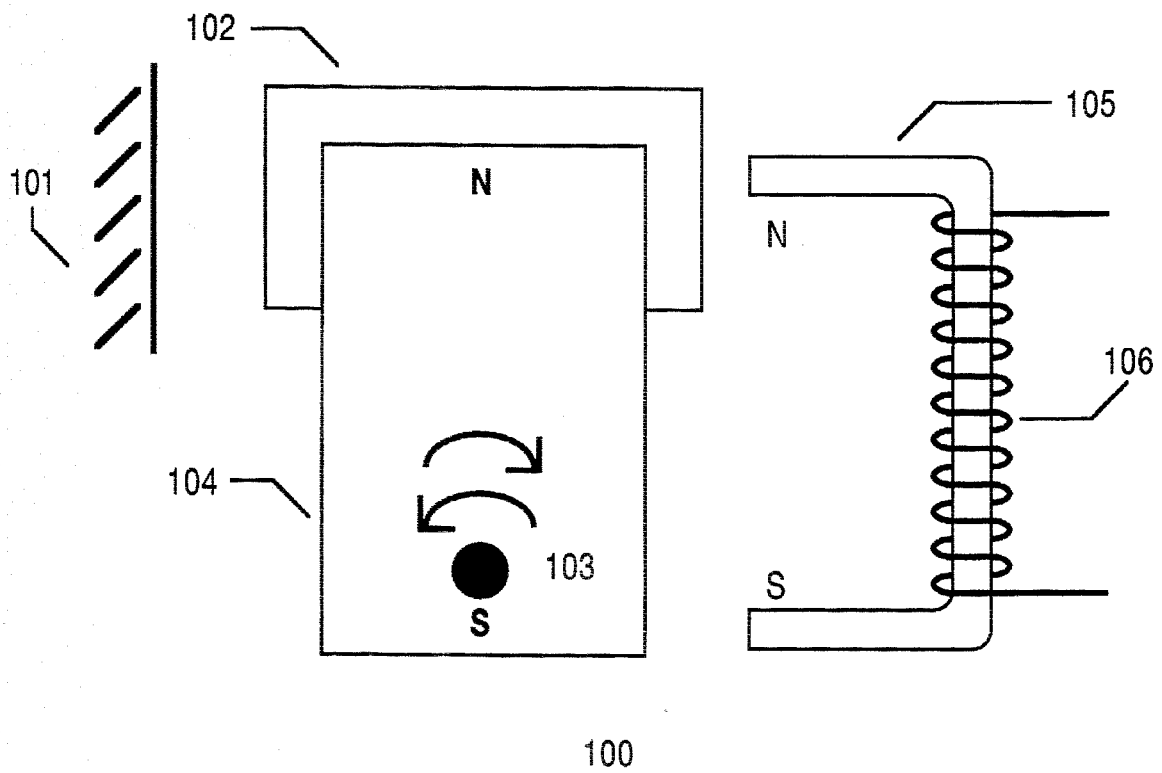
FIG. 3 illustrates an alternate embodiment of a vibrating apparatus in accordance with the present invention.

FIG. 3 illustrates an alternate embodiment of the present invention 100 that includes the bumper 101, the resilient material 102, the pivotal post 103, the polarizable material 104, and the excitation means 105 including windings 106. An example of the present invention, the vibrating apparatus, may comprise an excitation means of a soft variety electromagnet of steel #1018, a polarizable material or permanent magnet of the conventional type such as alnico or of the rare earth type such as neodymium, a resilient material of natural or silicon 40–80 durometer rubber, a bumper of conventional metal or polycarbonate, and a pivotal post comprising a metal post or a metal insert. The total diameter of the apparatus may be ½ inch in diameter and ⅛ inch in thickness.

This invention provides a means and method for alerting subscribers of low profile pagers in a vibratory manner which was not possible with a tubular vibrator or a motor driven with cam vibrator.

We claim:

1. A vibrating apparatus that provides vibrations in response to a predetermined event, the vibrating apparatus comprises:

a substrate having a substantially planar surface;

a pivotal post mechanically attached to the substrate in a substantially perpendicular manner;

a first bumper mechanically attached to the substrate in a substantially perpendicular manner and located a predetermined distance from the pivotal post;

a polarizable material having a substantially planar geometry, pivotally attached to the pivotal post and being substantially parallel to the substrate such that when the polarizable material is in motion, the direction of motion is substantially parallel to the substrate; and excitation means, operably coupled to the polarizable material, for providing a varying field such that the polarizable material is set in motion and repeatedly collides with the first bumper.

2. The vibrating apparatus of claim 1 further comprises a resilient material mechanically attached to the polarizable material such that when the polarizable material collides with the first bumper, the resilient material absorbs a portion of the impact.

3. The vibrating apparatus of claim 1, further comprising a resilient material disposed substantially between the polarizable material and the first bumper, such that when the polarizable material pivots toward the first bumper, the resilient material absorbs a portion of the impact.

4. A vibrating apparatus, comprising:

a substrate having a substantially planar surface;

a pivotal post mechanically attached to the substrate in a substantially perpendicular manner;

a first bumper mechanically attached to the substrate in a substantially perpendicular manner and located a predetermined distance from the pivotal post;

a polarizable material having a substantially planar geometry, pivotally attached to the pivotal post and being substantially parallel to the substrate such that when the polarizable material is in motion, the direction of motion is substantially parallel to the substrate; and at least a first magnet that includes excitable windings wrapped substantially therearound, operably coupled to the polarizable material and configured to provide a varying electromagnetic field substantially around the polarizable material.

5. The vibrating apparatus of claim 4 further comprises a resilient material mechanically attached to the polarizable material such that when the polarizable material collides with the first bumper, the resilient material absorbs a portion of the impact.

6. The vibrating apparatus of claim 4, further comprising a resilient material disposed substantially between the polarizable material and the first bumper such that when the polarizable material pivots toward the first bumper, the resilient material absorbs a portion of an impact.

7. A vibrating apparatus, comprising:

a substrate having a substantially planar surface;

a pivotal post mechanically attached to the substrate in a substantially perpendicular manner;

a first bumper mechanically attached to the substrate in a substantially perpendicular manner and located a predetermined distance from the pivotal post;

a polarizable material having a substantially planar geometry, pivotally attached to the pivotal post and being substantially parallel to the substrate such that when the polarizable material is in motion, the direction of motion is substantially parallel to the substrate; and at least a first magnet that includes excitable windings wrapped substantially therearound, operably coupled to the polarizable material and configured to provide a varying electromagnetic field substantially around the polarizable material.

* * * * *